US008136602B2

(12) United States Patent
Cline

(10) Patent No.: US 8,136,602 B2
(45) Date of Patent: Mar. 20, 2012

(54) METHOD AND APPARATUS FOR SEALING AND VENTING PRESSURIZED CASINGS OF GAS WELLS

(76) Inventor: Barry V. Cline, Innisfail (CA)

( * ) Notice: Subject to any disclaimer, the term of this patent is extended or adjusted under 35 U.S.C. 154(b) by 282 days.

(21) Appl. No.: 12/484,864

(22) Filed: Jun. 15, 2009

(65) Prior Publication Data

US 2010/0314128 A1 Dec. 16, 2010

(51) Int. Cl.
*E21B 33/03* (2006.01)

(52) U.S. Cl. ..... 166/379; 166/75.11; 73/40

(58) Field of Classification Search ..... 166/81.1, 166/75.11, 379; 73/40, 46
See application file for complete search history.

(56) References Cited

U.S. PATENT DOCUMENTS

| | | | | | |
|---|---|---|---|---|---|
| 1,448,243 | A * | 3/1923 | Wilson | 166/81.1 |
| 2,096,882 | A * | 10/1937 | Chernosky | 166/81.1 |
| 2,255,921 | A * | 9/1941 | Fear | 73/46 |
| 5,211,227 | A * | 5/1993 | Anderson | 166/84.1 |
| 5,246,067 | A * | 9/1993 | Heinonen et al. | 166/81.1 |
| 5,295,536 | A * | 3/1994 | Bode | 166/81.1 |
| 5,394,939 | A * | 3/1995 | Walker | 166/81.1 |
| D365,353 | S * | 12/1995 | Brewer | D15/199 |
| 5,551,511 | A * | 9/1996 | Holtby | 166/81.1 |
| 5,775,419 | A * | 7/1998 | Gramlich | 166/81.1 |
| 2002/0179300 | A1 * | 12/2002 | Gay et al. | 166/81.1 |

* cited by examiner

*Primary Examiner* — Daniel P Stephenson
(74) *Attorney, Agent, or Firm* — Seed IP Law Group PLLC

(57) ABSTRACT

Disclosed apparatus and methods permit well-site operators to retrofit existing wells in order to comply with local regulations that restrict the escape of annular natural gas from hydrocarbon wells. Such allows sealing around an exterior of surface and concentric production casings, both above and below the point of their intersection, then assembling a pressure vessel around that point and between those seals so as to capture and hold gas rising up an intercasing annulus, for periodic controlled venting.

13 Claims, 5 Drawing Sheets

METHOD AND APPARATUS FOR SEALING AND VENTING PRESSURIZED CASINGS OF GAS WELLS

BACKGROUND

1. Technical Field

The present disclosure relates generally to oil and gas wells, and more particularly to controlling gas leaking from an annular gap between surface and production casings thereof.

2. Description of the Related Art

Historically, hydrocarbon wells for producing natural gas have been drilled using a larger diameter surface casing inside which is inserted a relatively smaller production casing that extends down into the production zone where the production casing is perforated to permit the production tubing to be fluidly coupled to the hydrocarbon source and control flow to the surface. According to Oil Country Tubular Goods "OCTG" standards, the surface casing typically has a diameter of 177.8 mm or 7 inches, while the production casing typically has a diameter of 114.3 mm or 4.5 inches. Once both casings are in place, the installer "cements" the annulus that exists between an interior of the surface casing and an exterior of the production casing, so as to prevent pressurization of the casings from the escape of gas up the annulus.

The importance of the problems associated with uncontrolled gas leaks is well documented. Uncontrolled gas leaks can also result from tubing and casing leaks, poor drilling practices, improper cement selection, inadequate zonal isolation and production cycling. Modern regulation of the oil and gas industry has resulted in the need to install surface casing vents, including retroactively installing surface casing vents on older wells. Many wells experience sustained casing pressure due to from the uncontrolled migration of gas to the surface, associated with annular flow which results from a number of causes, including inadequate cementation. With the increase in the importance, and hence value, of natural gas, gas leaks have become a very significant issue. For environmental and other reasons it is therefore desirable to find an affordable and safe way to control the migration of gas to the surface even in wells that are no longer producing on a commercial scale.

Previous attempts by the gas production industry to address the problem have concentrated on variations of a one-piece solution to sealing the annular gap. In one example, well owners attempted to weld steel plates onto the surface casing stub to seal the gap to the production casing. Disadvantageously, not all of the production casings were centered in the surface casing, so the solution would not work on all wells. Such an approach also presented significant safety issues. For instance, if a welder accidentally burned a hole in the production casing, then there could be an uncontrolled escape of gas leading to injuries and/or death. Further, since some of these wells are already venting natural gas up the annulus between the casings—welding is not an option at all.

Another example was to suspend production at the well, pull the production tubing, set a bridge plug, remove the production tubing spool, install a surface casing spool with a vent, then reinstall everything else. The cost of this was typically $25,000 to $35,000 per well. Such is a prohibitively costly approach, particularly for wells that are no longer producing on a commercial scale. Accordingly it is desirable to identify a way to seal and vent well-heads, which is both safe and cost-effective.

Devices sometimes known as "mud cans" were used while pulling tubing or drill pipes still filled with fluid. The mud can would be wrapped around the joint between 2 lengths of production tubing or drill pipe and then quick-latched to hold the device in place while breaking the joint to disconnect the pipes so that the fluid could drain through a port and out to a vacuum truck. Mud cans were not built to hold pressure, they were more like a funnel for redirecting drilling fluid while disassembling a drill string. The mud cans had the same size opening at each end and were always open to the vacuum truck, but the mud cans still leaked fluid around the edges. While mud cans appear similar in structure to some embodiments of the structures disclosed in the detailed description herein, the similarities are superficial and mud cans must not be confused with such structures. Mud cans are for use in a very different application and have very different operational specifications. Basically, the so-called mud can is for a temporary, non-sealing application and is small in volume and light-gauge in construction—such that it is completely unsuitable for the current application.

BRIEF SUMMARY

An apparatus to prevent uncontrolled escape of annular gas from well-heads may be summarized as including an elongate pressure vessel consisting of at least two mating shell portions, configured to be assembled around an upper-most point of intersection between a surface casing and a production casing installed at a well-head, the production casing positioned concentrically within the surface casing, to thereby form an annulus between the surface and the production casings, each of the shell portions respectively having a lower end and an upper end, each of the upper and the lower ends having a cover portion to enclose a cavity when the shell portions are matingly coupled to one another, each of the cover portions proximate the upper end of each shell portion having a respective portion of an upper opening that when the shell portions are assembled is sized to closely be received around the production casing, and each of the cover portions proximate the lower end of each shell portion having a respective portion of a lower opening that when the shell portions are assembled is sized to closely be received around the surface casing; a respective mating flange around a mating perimeter of each the shell portions to provide a surface to releaseably fasten the shell portions to one another to assemble the pressure vessel; a number of mating flange seals coupled to the mating flanges; a number of opening seals coupled to a perimeter of each of the first and the second openings; and a number of fasteners to selectively couple the flange on each shell portion to one another so as to sealingly assemble the elongate pressure vessel around the point of intersection with the cavity in fluid communication with the annulus.

The apparatus may further include a vent outlet through either mating shell portions; and a venting fluidly coupled to the cavity, and operable to control escape of accumulated annular gas from the pressure vessel. The pressure vessel may be a cylindrical tank when assembled. There may be more than two mating shell portions. One of the mating flanges may have a groove and the other one of the mating flanges may have a ridge sized to be sealingly received in the groove. The mating flange seal may include at least one of a PTFE joint-sealant tape. The number of fasteners may include a number of bolts and nuts.

The apparatus may further include an upper opening flange portion welded about a respective portion of the upper opening of each of the shell portions; and a lower opening flange portion welded about a respective portion of the lower opening of each of the shell portions. The respective shell portions may each include an upper opening flange portion and a lower opening flange portion which are unitary single piece constructions of the shell portions positioned about a respective portion of the upper and the lower openings of each of the shell portions.

A method of preventing the uncontrolled escape of annular gas from a well-head, the well-head having an annulus at the upper-most point of intersection between a surface casing and a production casing positioned concentrically within the surface casing thereby forming the annulus between the surface and production casings may be summarized as including installing at least a first seal around an exterior of the production casing above the point of intersection; installing at least a second seal around an exterior of the surface casing below the point of intersection; assembling a pressure vessel around the point of intersection, the pressure vessel forming an enclosed sealed cavity between the first seal around the exterior of the production casing and the second seal around the exterior of the surface casing; and allowing annular gas to collect inside the sealed cavity.

The method may further include controllably venting the collected annular gas from the pressure vessel; and measuring a flow of the annular gas vented so as to eliminate sustained casing pressure from the well-head.

An apparatus to prevent uncontrolled escape of annular gas from well-heads may be summarized as including an elongate pressure vessel consisting of at least two mating shell portions, configured to be assembled around an upper-most point of intersection between a surface casing and a production casing installed at a well-head, the production casing positioned concentrically within the surface casing, to form an annulus between the surface and the production casings, each of the shell portions respectively having a lower end and an upper end, each of the lower and the upper ends respectively having a cover portion to enclose a cavity when the shell portions are matingly coupled to one another; a mating flange around a mating perimeter of each the shell portions to allow fastening of the shell portions to one another to assemble the pressure vessel at the well-site; a TEADIT 24B PTFE joint-sealant tape positioned between opposing ones of the mating flanges when the shell portions are assembled to one another; a production casing receiving flange through each cover portion at the upper end of each shell portion, the production casing receiving flange having an inner radius of about 2.25 inches (57.15 mm), for assembly around a production casing installed at the well-head; a surface casing receiving flange through each cover portion at the lower end of each shell portion, the surface casing receiving flange having an inner radius of 3.5 inches (88.9 mm),for assembly around a surface casing installed at the well-head; a number of pieces of TEADIT 24B PTFE joint-sealant tape positionable between the production and the surface casing receiving flanges and the production and surface casings, respectively; and a number of fasteners to selectively fasten the mating flanges on each shell portion to adjacent ones of the shell portions to sealingly assemble the elongate pressure vessel around the point of intersection such that the cavity is in fluid communication with the annulus.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with well-sites have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Further more, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings and Abstract of the Disclosure provided herein are for convenience only and do not interpret the scope or meaning of the embodiments.

Figure 1:
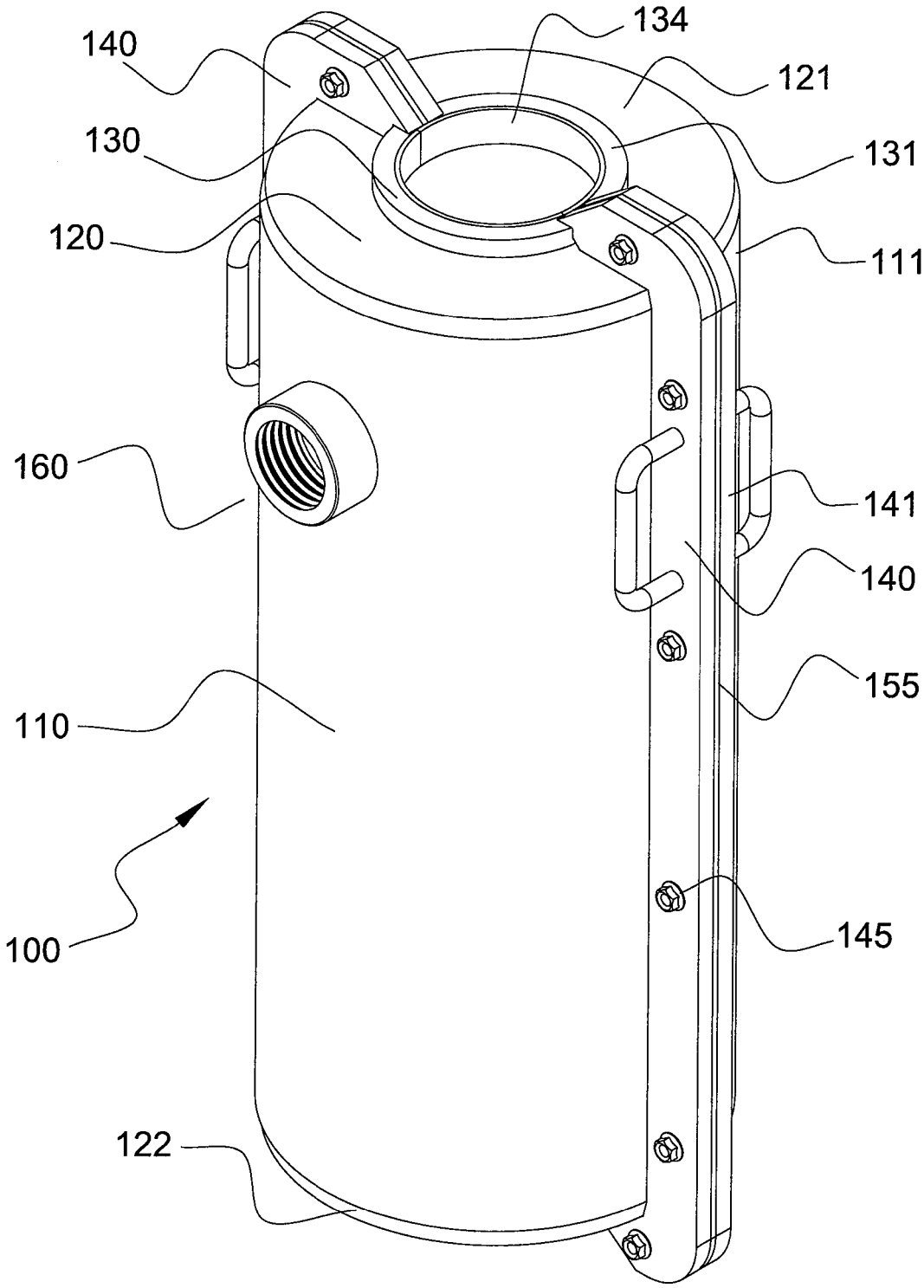
FIG. 1 is a top, front, right side isometric view of a well-casing annular gas pressure seal and venting apparatus, according to one illustrated embodiment.

FIG. 1 shows a well-casing annular gas pressure seal and venting apparatus denoted generally as 100, according to one illustrated embodiment.

The well-casing annular gas pressure seal and venting apparatus includes a number of mating shell portions, for example mating half-shells 110 and 111 that are securely fastenable to one another by any suitable fasteners. As shown, first half-shell 110 is coupled (typically welded) to mating flange 140 having a series of holes 146 (not shown) through which bolts 145 may be inserted to mate mating flange 140 to mating flange 141 of second half-shell 111. It is contemplated that other forms of fastener, such as rivets or suitable clamps and/or hinges may be used in place of the illustrated bolts.

Each half-shell also has two opening flanges, (e.g., semi-circular flanges), one on each end of the half-shell 110, 111, projecting through top and bottom end cover portions (e.g., half-covers) 120, 122 respectively, of half-shell 110 and top and bottom end cover portions (e.g., half-covers 121, 123) (FIG. 3) respectively, of half-shell 111.

A corresponding pair of opening or semi-circular flanges 130, 131 with an associated seal 134, and pair of opening or semi-circular flanges 132, 133 with an associated seal 135 (FIG. 3), are constructed to sealingly engage well-casings (see FIG. 5) of different sizes. The pair of opening or semi-circular flanges 130, 131 are each sized to closely accommodate OCTG standard production casing when the semi-circular flanges 130, 131 are mated together. Thus the flanges 130, 131 may be denominated as production casing receiving flanges. The pair of opening or semi-circular flanges 132, 133 are sized to closely accommodate OCTG standard surface casing when the semi-circular flanges 132, 133 are mated together. Thus, the flanges 132, 133 may be denominated as surface casing receiving flanges.

When semi-circular flanges 130 and 131 are mated to one another, they form a toroid that seals the upper end of apparatus 100 tightly around the production casing so as to prevent annular gas from escaping apparatus 100 except through vent outlet 160. At a lower end of apparatus 100, semi-circular flanges 132 and 133 mate to form a toroid that seals the bottom of apparatus 100 tightly around a surface casing to prevent annular gas escape. Half-shells 110 and 111 are illustrated in a cylindrical profile, but it is understood that apparatus 100 will function substantially the same using other profiles such as rectangular, hexagonal, or elliptical.

Figure 2:
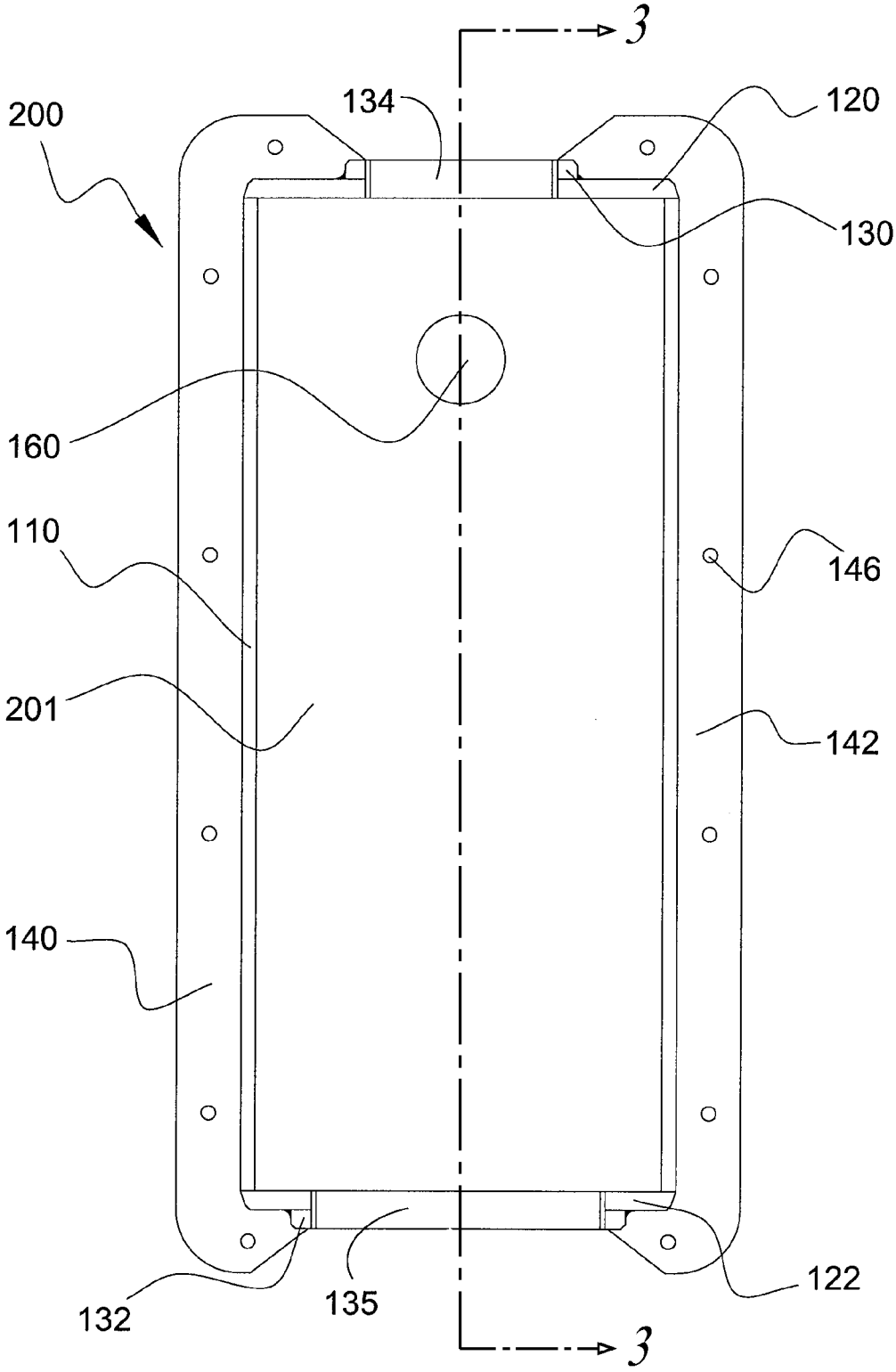
FIG. 2 is a front elevational view the well-casing annular gas pressure seal and venting apparatus of FIG. 1.

FIG. 2 shows a half-shell assembly 200.

The half-shell assembly 200 is comprised of half-shell 110 physically coupled to flange 140, end half-covers 120, 122, and semi-circular flanges 130, 132, which are all visible together in FIG. 2 along with half-cavity 201, from which gas may be vented via vent outlet 160. The face 142 of the flange 140 may have any suitable number of holes 146 through which to apply mechanical fasteners to fasten half-shell 110 to half-shell 111. The half-cavity 201 surrounds the point of intersection of the casings when installed. According to an alternate embodiment of apparatus 100, half-shells 110,111 may be constructed with end half-covers 120, 122, 121, 123, respectively, sufficiently thick to act as flanges. Openings may be machined in the end half-covers 120, 122, having the same inner diameter as semi-circular flanges 130 and 132 respectively. Openings may be machined in the end half-covers 121, 123 having the same inner diameter as semi-circular flanges 132, 133. The end half-covers may integrally form the flanges as an integral one piece construction, requiring no welding or other coupling acts. Such may eliminate the need to install any semi-circular flanges into the four end half-covers 120, 121, 122, 123 of apparatus 100.

To enhance the sealing effect of flanges 140, 141, as well as the toroids formed by the pairs of the semi-circular flange pairs 130, 131 and 132, 133, seals 155, 134 and 135, respectively, may comprise any suitable material such as a gasket compound capable of conforming to complex or rough or pitted surfaces typically encountered on weather aged tubular elements at well-sites. According to one embodiment, seal 155 is a joint sealant such as that manufactured by W.L. Gore & Associates, Inc. Another suitable sealing product, manufactured by TALuft, is sold as TEADIT 24B, which is a PTFE joint-sealant tape capable of withstanding relatively high pressures (4200 kPa or 600 PSI) SCP without failure. Whether in the form of a tape, a gel compound, a pre-shaped sheet gasket, a form-in-place gasket, or any similar treatment or combination of the foregoing, the seal 155 applies to face 142 of planar flange 140 so as to prevent pressurized gas escape between flanges 140 and 141. Similarly, seals 134 and 135 prevent pressurized gas escape between a production casing and pair of semi-circular end flanges 130, 131, and, a surface casing and pair of semi-circular end flanges 132, 133, respectively.

Flange 140 as illustrated is shown with face 142 having a simple planar design to which any suitable seal 155 may be applied to prevent annular gas leakage from shells 110, 111 to whatever pressure level the local authorities specify. However, it is contemplated that flange 140 may be manufactured with interlocking elements such that there is a groove (not shown) on one half-shell and a corresponding ridge (not shown) on the other half-shell. Such may accommodate very high pressure applications. Such may be implemented with narrower flanges.

Figure 3:
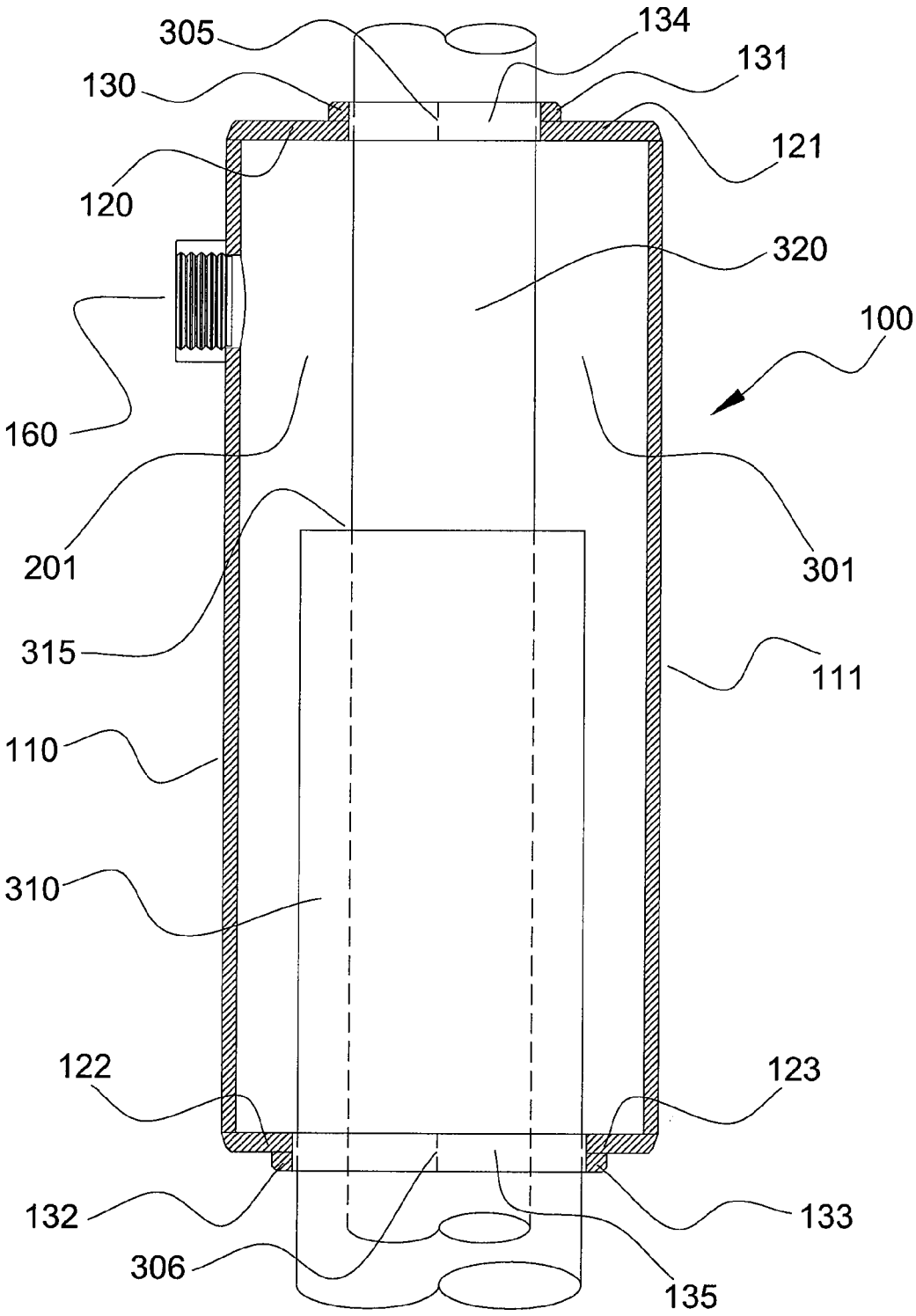
FIG. 3 is a partial cross-sectional view of the well-casing annular gas pressure seal and venting apparatus of FIG. 2, taken along a section line 3-3 in FIG. 2.

FIG. 3 shows the apparatus 100 in a partially cut-away side view.

In particular, a planar butt joint 305 between semi-circular flanges 130, 131 is visible, as well as a butt joint 306 between semi-circular flanges 132, 133. However, it is similarly contemplated that joint configurations other than a planar joint may be employed. For example, either the semi-circular flanges or the openings in the half-shells may be manufactured with interlocking elements, such that there is a groove on one and a corresponding ridge on the other half-shell assembly, if needed or desired for any reason. Regardless of the particular sealing structure employed for a particular embodiment and installation, once sealed around the casings, apparatus 100 accumulates and contains annular gas in half-cavities 201 and 301 until vented. Also visible in FIG. 3 is a point 315 (vertical level) where surface casing 310 intersects production casing 320 inside the cavity formed by combining half-cavities 201, 301. Seals 135, 134 are visible surrounding an exterior of surface casing 310 and production casing 320, respectively.

Figure 4:
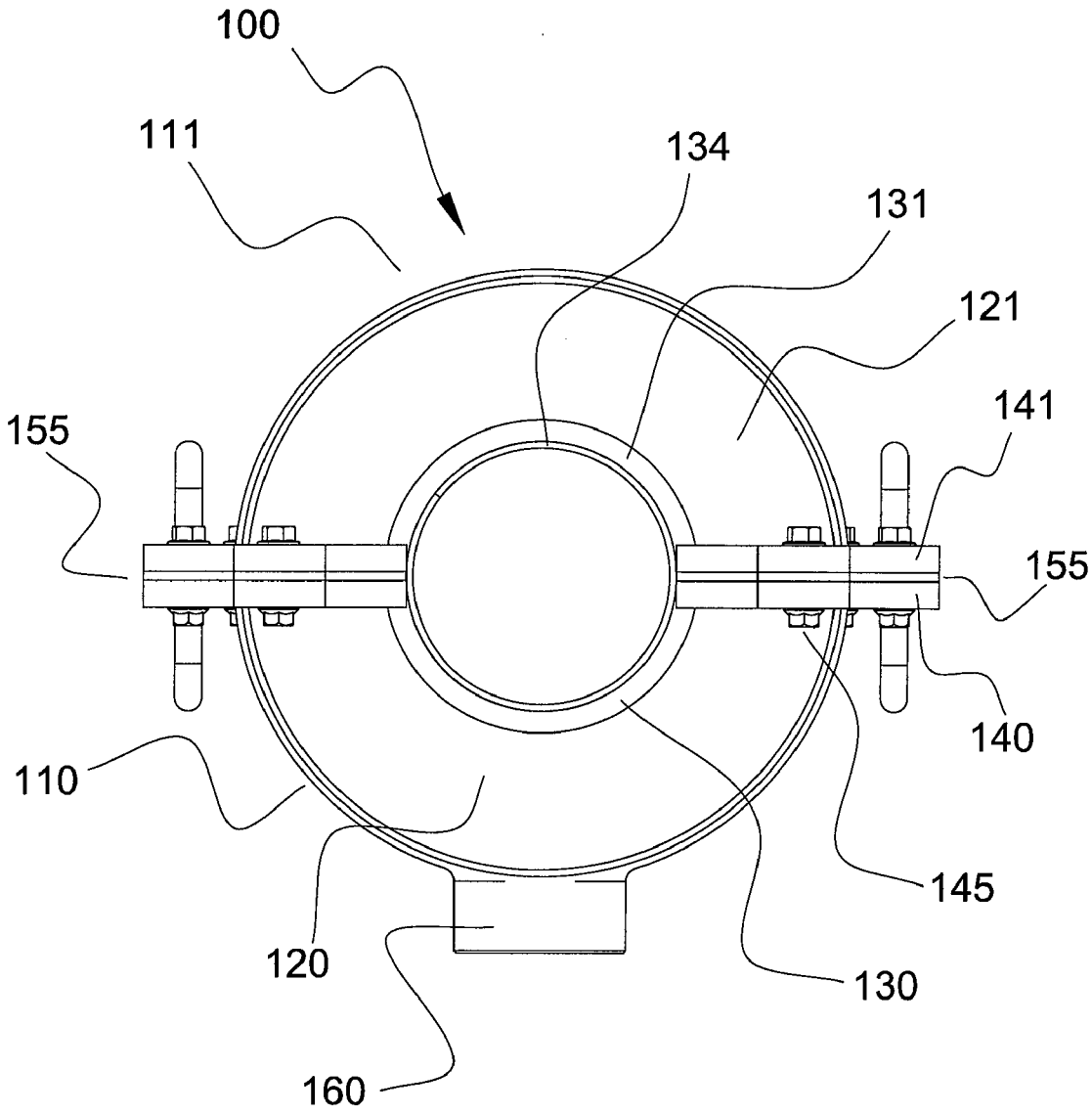
FIG. 4 is top plan view of the well-casing annular gas pressure seal and venting apparatus of FIG. 1.

FIG. 4 shows half-shells 110, 111 fastened together using fasteners such as bolts 145.

In particular, top seal 134 is visible along the inner circumference of the toroid formed by semi-circular flanges 130 & 131.

In operation, apparatus 100 is installed over the well-site casings at the level, earlier identified by point 315, where the surface and production casings begin to overlap at the top end of the surface casing. Apparatus 100 may be manufactured in any suitable length(s), but is typically approximately 2 feet long such that bottom semi-circular flanges 132, 133 engage surface casing 310 approximately one foot below the upper end of the surface casing 310 at point 315, while top semi-circular flanges 130, 131 engage production casing 320 approximately one foot above that same level at point 315. Such results in the "joint" being roughly vertically centered inside half-shells 110, 111. Prior to fastening half-shells 110, 111 into position at any suitable level proximal point 315, apparatus 100 may be adjusted vertically up or down to ensure that all semi-circular flanges are positioned over straight segments of undamaged exterior face on their respective casings. Such permits an effective gas tight seal of annular gas inside cavity 201, 301. At a site where either or both casings are damaged over a vertical span sufficient to prevent sealing a standard length version of apparatus 100, it is to be understood that an extended custom length apparatus 100 (working in the same manner) can be manufactured so as to reach far enough along the casings to permit the installer to seal around undamaged segments of each casing.

Figure 5:
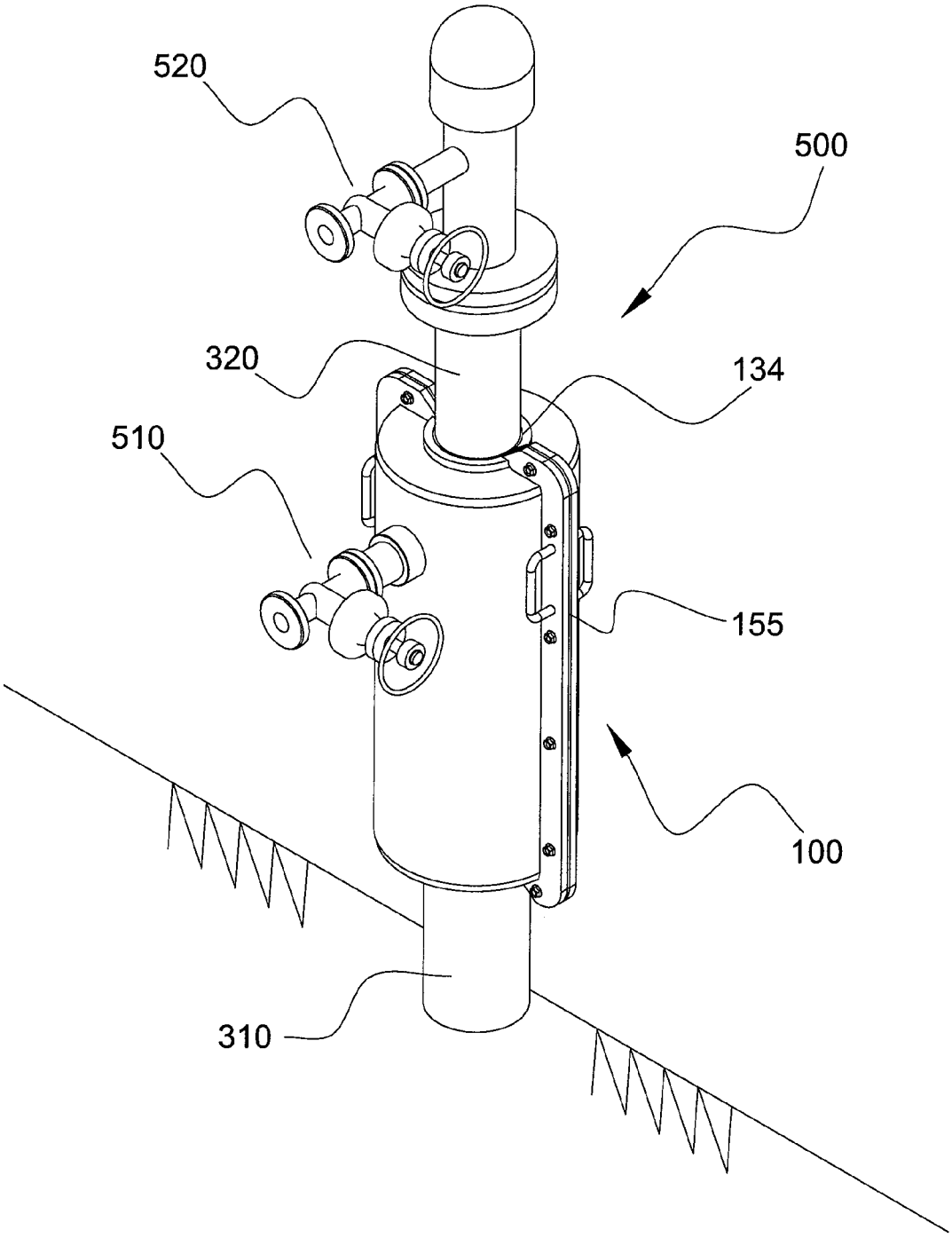
FIG. 5 is an isometric view of an well-casing annular gas pressure seal and venting apparatus installed at a well-site, according to one illustrated embodiment.

FIG. 5 shows the apparatus 100 installed at a typical well-site 500, according to one illustrated embodiment.

The apparatus 100 enclosing point 315 being at the level of intersection (not visible) between surface casing 310 and production casing 320 through which casing, production tubing (not shown) delivers a hydrocarbon flow to any suitable valve assembly 520. Vent assembly 510 is fluidly coupled to vent outlet 160 to permit a well operator to periodically monitor, measure flow rates, and divert annular gas accumulated in apparatus 100, so as to release any sustained pressure therein. Conventional monitor or measuring equipment, for example gas flow meters may be employed.

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the disclosure, as will be recognized by those skilled in the art of gas flow control. The teachings provided herein of the various embodiments can be applied to other apparatus that control gas flow at well sites, not necessarily the exemplary well-casing annular gas pressure seal and venting apparatus generally described above.

For example, while illustrated as two mating halves, the apparatus may include more than two portions which mate together in a similar fashion to the two mating halves. Also for example, while illustrated as employing a circular cross-section, other geometric shapes may be employed.

The various embodiments described above can be combined to provide further embodiments. To the extent that they are not inconsistent with the specific teachings and definitions herein, all commonly assigned U.S. patents, U.S. patent application publications, U.S. patent applications, referred to in this specification and/or listed in the Application Data Sheet are incorporated herein by reference, in their entirety. Aspects of the embodiments can be modified, if necessary, to employ structures and concepts of the various patents and applications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

I claim:

1. An apparatus to prevent uncontrolled escape of annular gas from well-heads, the apparatus comprising:

an elongate pressure vessel consisting of at least two mating shell portions, configured to be assembled around an upper-most point of intersection between a surface casing and a production casing installed at a well-head, the production casing positioned concentrically within the surface casing, to thereby form an annulus between the surface and the production casings, each of the shell portions respectively having a lower end and an upper end, each of the upper and the lower ends having a cover portion to enclose a cavity when the shell portions are matingly coupled to one another, each of the cover portions proximate the upper end of each shell portion having a respective portion of an upper opening that when the shell portions are assembled is sized to closely be received around the production casing, and each of the cover portions proximate the lower end of each shell portion having a respective portion of a lower opening that when the shell portions are assembled is sized to closely be received around the surface casing;

a respective mating flange around a mating perimeter of each the shell portions to provide a surface to releaseably fasten the shell portions to one another to assemble the pressure vessel;

a number of mating flange seals coupled to the mating flanges;

a number of opening seals coupled to a perimeter of each of the first and the second openings; and a number of fasteners to selectively couple the flange on each shell portion to one another so as to sealingly assemble the elongate pressure vessel around the point of intersection with the cavity in fluid communication with the annulus.

2. The apparatus as claimed in claim 1, further comprising:

a vent outlet through either mating shell portions; and a vent assembly coupled to the cavity, and operable to control escape of accumulated annular gas from the pressure vessel.

3. The apparatus as claimed in claim 1 wherein the pressure vessel is a cylindrical tank when assembled.

4. The apparatus as claimed in claim 1 wherein there are more than two mating shell portions.

5. The apparatus as claimed in claim 1 wherein one of the mating flanges has a groove and the other one of the mating flanges has a ridge sized to be sealingly received in the groove.

6. The apparatus as claimed in claim 1 wherein the mating flange seal comprises at least one of a PTFE joint-sealant tape.

7. The apparatus as claimed in claim 1 wherein the number of fasteners comprises a number of bolts and nuts.

8. The apparatus as claimed in claim 1, further comprising:

an upper opening flange portion welded about a respective portion of the upper opening of each of the shell portions; and a lower opening flange portion welded about a respective portion of the lower opening of each of the shell portions.

9. The apparatus as claimed in claim 1 wherein the respective shell portions each include an upper opening flange portion and a lower opening flange portion which are unitary single piece constructions of the shell portions positioned about a respective portion of the upper and the lower openings of each of the shell portions.

10. A method of preventing the uncontrolled escape of annular gas from a well-head, the well-head having an annulus at the upper-most point of intersection between a surface casing and a production casing positioned concentrically within the surface casing thereby forming the annulus between the surface and production casings, the method comprising:

installing at least a first seal around an exterior of the production casing above the point of intersection;

installing at least a second seal around an exterior of the surface casing below the point of intersection;

assembling a pressure vessel around the point of intersection, the pressure vessel forming an enclosed sealed cavity between the first seal around the exterior of the production casing and the second seal around the exterior of the surface casing; and allowing annular gas to collect inside the sealed cavity.

11. The method as claimed in claim 10, further comprising:

controllably venting the collected annular gas from the pressure vessel; and measuring a flow of the annular gas vented so as to eliminate sustained casing pressure from the well-head.

12. An apparatus to prevent uncontrolled escape of annular gas from well-heads, the apparatus comprising:

an elongate pressure vessel consisting of at least two mating shell portions, configured to be assembled around an upper-most point of intersection between a surface casing and a production casing installed at a well-head, the production casing positioned concentrically within the surface casing, to form an annulus between the surface and the production casings, each of the shell portions respectively having a lower end and an upper end, each of the lower and the upper ends respectively having a cover portion to enclose a cavity when the shell portions are matingly coupled to one another;

a mating flange around a mating perimeter of each the shell portions to allow fastening of the shell portions to one another to assemble the pressure vessel at the well-site;

a piece of a joint-sealant tape positioned between opposing ones of the mating flanges when the shell portions are assembled to one another;

a production casing receiving flange through each cover portion at the upper end of each shell portion, the production casing receiving flange having an inner radius of about 2.25 inches (57.15 mm), for assembly around a production casing installed at the well-head;

a surface casing receiving flange through each cover portion at the lower end of each shell portion, the surface casing receiving flange having an inner radius of 3.5 inches (88.9 mm), for assembly around a surface casing installed at the well-head;

a number of pieces of a joint-sealant tape positionable between the production and the surface casing receiving flanges and the production and surface casings, respectively; and a number of fasteners to selectively fasten the mating flanges on each shell portion to adjacent ones of the shell portions to sealingly assemble the elongate pressure vessel around the point of intersection such that the cavity is in fluid communication with the annulus.

13. The apparatus of claim 12 wherein the joint-sealant tape is a polytetrafluoroethylene (PTFE) joint-sealant tape.

* * * * *